US005697177A

United States Patent [19]

Ludlow et al.

[11] Patent Number: 5,697,177

[45] Date of Patent: Dec. 16, 1997

[54] LOCKING TAG FOR BANDED MERCHANDISE

[75] Inventors: Robert B. Ludlow; Brian D. Larsen, both of Worthington, Minn.; John B. Linquist, Sibley, Iowa

[73] Assignee: Bedford Industries, Inc., Worthington, Minn.

[21] Appl. No.: 615,772

[22] Filed: Mar. 13, 1996

[51] Int. Cl.[6] ..... G09F 3/14

[52] U.S. Cl. ..... 40/665; 40/663

[58] Field of Search ..... 40/316, 664, 663, 40/665; 24/130, 129 B, 18

[56] References Cited

U.S. PATENT DOCUMENTS

| | | | |
|---|---|---|---|
| D. 225,968 | 1/1973 | Crawford et al. . | |
| 566,272 | 8/1896 | Martin | 24/18 |
| 1,413,626 | 4/1922 | Stout | 24/18 |
| 1,458,444 | 6/1923 | Scott | 40/663 |
| 1,485,996 | 3/1924 | Stout | 24/18 |
| 1,830,014 | 11/1931 | Brady | 24/18 |
| 2,246,229 | 6/1941 | Wohlmuth . | |
| 2,438,651 | 3/1948 | Schlegel | 24/18 |
| 2,669,047 | 2/1954 | Rieger . | |
| 2,981,990 | 5/1961 | Balderree, Jr. . | |
| 3,264,698 | 8/1966 | Wright . | |
| 3,270,872 | 9/1966 | Paxton . | |
| 4,379,372 | 4/1983 | Alexander et al. | 40/316 X |
| 4,760,624 | 8/1988 | Fish . | |

*Primary Examiner*—Joanne Silbermann
*Attorney, Agent, or Firm*—Robert C. Baker

[57] ABSTRACT

The locking tag for fastening to band material on merchandise is made of sheet material having an information part and a header part united together. The information part is for printed matter, which may include a scannable product identification marking. The header part has an open mouth in its outer perimeter edge and a holding orifice inwardly spaced from the open mouth. A slit entry channel extends from the open mouth along a line terminating as a slit entrance into the orifice. Fingers on opposite sides of the entry channel extend in opposite directions. One finger is an elongated hooking finger, and the other finger is a camming finger having a camming surface and a terminal hook lock at the entrance of the entry channel into the orifice. A band material in the holding orifice is substantially irreversibly locked in the orifice. The elongated hooking finger is easily latched over a section of band material to cause movement of the band material along the camming surface into the holding orifice with one sweeping hand movement.

41 Claims, 2 Drawing Sheets

LOCKING TAG FOR BANDED MERCHANDISE

BACKGROUND OF THE INVENTION

This invention relates to a locking tag for fastening to band material on merchandise. The locking tag has an information part for printed matter. The printed matter may include scannable code material, or label or marking information, or advertising. Varied information may be employed on the locking tag.

Merchandise of many different types is banded in one way or another for packaging or preparing the merchandise for presentation to consumers and for movement of the merchandise in channels toward ultimate marketing to the consumer. For example, a band such as a common string or a rubber band or a twist tie ribbon may be placed about a box of merchandise or about multiple boxes or about clumps of merchandise or about rolled or folded merchandise such as a newspaper. Conveniently affixing a marker tag onto such merchandise in a supremely quick and simple and reliable manner is by no means as simple as it may at first appear.

Mechanical stapling of a marker or label to banded merchandise is a suitable expedient only in those instances where the merchandise itself is not damaged by the stapling. The stapling approach is completely unsatisfactory where the merchandise is agricultural produce such as carrots or radishes that are clumped together with a band around them. There is no place to staple anything except on the band, and the band is frequently not easily accessible for stapling purposes.

Adhesively coated tags, if of any substantial size, may interfere or obscure markings or features on merchandise or on a container for the merchandise. They are unsuitable for use on most banded agricultural produce.

Affixing tags by tying a string of the tag to a band about banded merchandise is far too time consuming to be practical under the economic conditions facing most businesses today. The need is for tags that can be affixed to banded merchandise in a quick and simple and reliable manner.

The use of plastic closures to affix tags or markers to bands about merchandise has heretofore been proposed; but the closures heretofore proposed for that purpose have been of symmetrical design and require an act of pressing them against the band about merchandise in order to fix them on the band. The pressing either tends to crush the merchandise or requires the extra step of lifting the band from the merchandise in order to press and fix the closure to the band. Either a risk of damage occurs or ease of affixing is sacrificed.

While the usefulness of the new locking tags of this invention extends far beyond affixing the same to banded agricultural produce, it is the tagging of banded agricultural produce that presents the most severe problem. Whether such produce is tagged at the time it is banded in harvesting, or later tagged by a middle person through whom the merchandise is passed on its way to retailers, or by the retailers themselves, the tagging has to be accomplished in a quick, simple, reliable, and also economical manner.

Mass merchandising outlets such as superstores or supermarkets have placed more and more emphasis on scannable merchandise markings as the key means to control the accuracy of processing and avoid losses at the check-out counter, and they want economy and sales promotion markings.

The trend in marking extends well beyond scannable tags having simple bar codes (for product identification) or Universal Product Codes (UPC—a combination of bar code and numbers for product identification and usually also a price specification) or product look-up numbers (PLU numbers). Nutritional facts are being more and more required on some products by federal law, and are in general more and more expected by consumers. Recipes, nutritional information, serving suggestions, storage directions, origin of product information (e.g., produced in the U.S.A.), and everything else that could possibly help a consumer make a purchasing decision, and help retailers with accuracy at check-out (and also help retailers and their suppliers, including growers, with inventory monitoring), can be a candidate for an appropriate merchandise tag.

Further, merely affixing a tag with appropriate markings on banded agricultural produce does not solve the problem if the tag is damaged or dislodged from the merchandise during any subsequent step of handling or processing such as washing or cleaning.

In short, the effective tagging of banded clumps of agricultural produce in an economical manner with all of the data required or desired by superstores, and without damage to the merchandise, and with worker motions of a minimal and economical nature satisfactory to everyone in getting the tag affixed, and with tags that stay in place and are not damaged during product cleaning or washing, has presented a very special challenge. This invention provides a solution having utility well beyond the tagging of banded agricultural produce.

SUMMARY OF THE INVENTION

The new tag of this invention comprises a sheet material having an information part and a resilient header part united together along a border between the parts. The information part is for printed matter. The printed matter may consist of advertising alone or product information alone. It may contain a great variety of useful information.

The header part has an outer perimeter edge about it except at its border. An open mouth is in the outer perimeter edge. The open mouth has an upper lip edge in opposing relationship to a lower lip edge and has a depth dimension extending inwardly from the outer perimeter edge. A holding orifice is in the header part, and this holding orifice is inwardly spaced from the open mouth as well as from the outer perimeter edge. A slit entry channel extends from the open mouth transversely through the header part along a line terminating as a slit entrance into the orifice itself. The result of this relationship is that oppositely extending fingers are created on opposite sides of the slit entry channel. One finger is an elongated hooking finger which extends from the orifice outwardly to terminate at the upper lip edge of the open mouth. The other finger is a camming finger and has a camming surface extending from the lower lip edge of the open mouth to the orifice. A terminal hook lock is formed by the camming finger at the slit entrance of the entry channel into the orifice.

There are other significant features or relationships for the ideal header part. The hooking finger has a length greater than its mean width, and its mean width is defined as the distance between (i) the outer perimeter edge of the header part and (ii) the entry channel, said distance being measured at approximately the midpoint between the ends of the hooking finger. The hook lock of the camming finger is integrated with the holding orifice so that a section of band material in the holding orifice is substantially irreversibly locked in the holding orifice by the hook lock against exit from that orifice.

The elongated hooking finger of the locking tag performs a very special function. It is easily latched transversely over a section of band material about merchandise to allow movement of the band material along the camming surface into the holding orifice with one sweeping hand movement.

Therefore, when a worker makes a singular swinging motion of the locking tag so as to cause the elongated finger of the header part to pass under a length or stretch of band material about a clump of produce, and simultaneously cause the camming surface to pass over the exposed side of the band material, the force of the swinging motion is sufficient to cause the band material to move through the curved slit entry channel past the hook lock of the camming surface into the holding orifice. Once in that orifice, the band material is, for all practical intents and purposes, substantially irreversibly retained therein.

From the standpoint of employing minimal material to keep costs down, and especially minimum quantities of plastic material, it is desirable to make the information part of the total locking tag structure thinner in character than the header part. The thin information part may be extremely flexible, whereas the header part, while desirably flexible, should not be so flexible as to be easily dislodged from a locking condition on a band material. The appropriate terminology characterizing the header is that it is resilient, that is, capable of distortion, and yet is sufficiently stiff to return to a non-distorted state relatively quickly after being distorted. The header part is obviously somewhat flexible in order to permit distortion, but the flexibility is limited and stiffness plays a part in the features of resilience and locking for the header part.

Still further benefits and details and advantages of the invention will become evident as this description proceeds.

DESCRIPTION OF THE PREFERRED EMBODIMENT(S)

Figure 1:
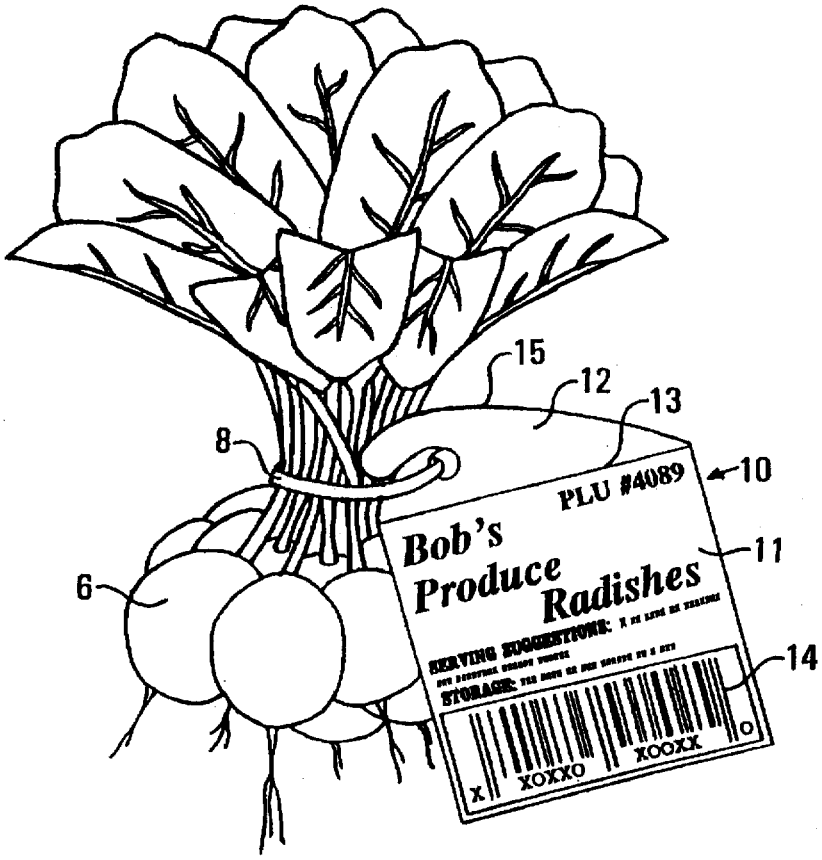
FIG. 1 is a schematic side view of the new locking tag of the invention in a locked condition on a band of material (e.g., rubber band or twist tie) about a clump of vegetables, namely radishes, and particularly illustrates marking information on the information part and several significant features for the header part.

Refer first to the drawing. A common practice in the past has been to clump agricultural produce such as radishes 6 and to hold the clump together by a band 8 (e.g., a band of rubber or twist tie material). This invention adds a new locking tag 10 to the banded produce, or to the band about any variety of merchandise.

The new locking tag 10 is sheet material in character. It is preferably water-resistant in that it does not disintegrate when placed in water. In fact, not only the sheet material but also the printing on it, and especially any scannable product identification matter on it, should be sufficiently water resistant to avoid disintegration or destruction when subjected to water and washing operations. The more ideal materials for formulating the sheet material are plastic, e.g., polyolefinic thermoplastics, polyesters, as well as others. Polymers of ethylene, propylene, styrene, as well as a variety of other monomers and mixtures of monomers (e.g., to make co-polymers and ter-polymers, etc.) can be used. The polymers may be formulated so that printing is readily accepted on the surface of the sheet material or treated with special surface treatments to effect acceptance of printing. One way of attaining printable economical sheet material is to form the sheet material as a laminate, using paper 18 (suitably of tissue thinness) on opposite sides and using an internal polyolefinic thermoplastic layer or core 19 to which the paper material on opposite sides is fused (see FIG. 3). Fusion under heated conditions is suitable. (As used herein, paper has the standard dictionary meaning, namely a felted or matted sheet of any of a variety of cellulosic fibers, including but not limited to fibers from wood, cotton, rice, and a host of other sources; but useful papers may be exceedingly thin on opposite sides of a plastic core.) The exact structure and composition of sheet material employed in practicing the invention may vary. While economic raw materials are highly desired, it sometimes is possible to attain the benefits of economy by using somewhat more expensive raw material requiring fewer processing steps to fabricate the sheet for the tag. The result can provide an economy as great as that achieved using exceedingly economical raw material but requiring more processing (as in the case of paper fused to opposite sides of an internal polyethylene layer or core). Thus, paper laminated to plastic is not critical for practice of this invention. A polyolefin thermoplastic printable much the same as paper is commercially available under the trademark "Teslin" from PPG Industries of Pittsburgh, Pa. Any of a variety of commercially available water-insoluble inks compatible or accepted on a sheet and retained thereon, and in any desired color, may be used to print the markings and details on the base sheet stock for the new locking tags. This technology is readily understood in the art. (If it should be desired to use water-soluble ink markings, a thin film of water-insoluble plastic may be applied over them to create the desired or needed water resistance.)

The locking tag has an information part 11 and a resilient header part 12 united together. They may be integrally united together in a manner that ideally does not have any seam or special adhesive or mechanical fastener holding the two parts together. That is what is meant by "integrally united"; the two parts are in essence the same sheet, with the header merging into the information part. The two parts are united along a zone called a border. The zone of uniting or connection is referred to as a border simply because the header part is looked upon as being distinct from the information part. The header is generally exceedingly small in size compared to the information part. In other words, the header part area size is significantly smaller than the information part area size. For example, the header may be so small as to measure little more than (or approximately) just one square centimeter, or possibly 1 cm by 2 cm. A versatile header structure will rarely exceed an area embraced by about 2 cm in one direction and 3 cm in a perpendicularly oriented direction. Headers in excess of 3 or 4 cm in each perpendicular direction are possible but needlessly large. Nevertheless, large headers may be used, even though the critical header performance features can all be in a compact area, such as just discussed.

In contrast to the header area, the information part of the locking tag will generally be quite large in area. A minimum size would be at least about 2 cm square or 2 by 3 cm (e.g., a rectangle of about an inch or slightly more in each direction). A size of at least about 4 cm (e.g., one and one-half inches) in each perpendicular direction will generally be required to accommodate the variety of printed matter desired on most information parts. Sizes of 8 or 10 or 12 cm (e.g., 3, 4, or 5 inches) in one direction perpendicular to a size varying from 4 to 20 cm (e.g., 1.5 to 8 inches may be used in the practice of the invention, especially when the information part is devoted primarily to advertising (a likely use where the new tag is attached to banded newspapers). Larger area sizes for the information part are possible but not likely to be employed for most tags.

Figure 7:
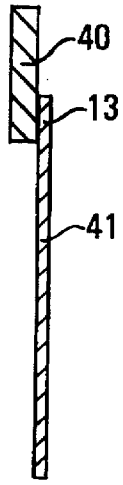
FIG. 7 is a schematic cross-sectional view of a locking tag of the invention having the material of its header part overlapping the material of its information part and with its border at the edge of the header material.

The distinction between the header part and information part can be created by a border of marking (e.g., color) on the information part. A change of thickness can also create the zone or line for the border between the header and information parts. Still further, the zone forming the border 13 may be at the lower edge of the header over which material of the information may overlap to form a junction or connection between the header and information parts (see FIG. 7). For example, the header part 40 in FIG. 7 may consist of relatively stiff but resilient polystyrene plastic (e.g., about 25 mils thick), and the information part 41 in FIG. 7 may consist of a very flexible, extremely thin sheet of any suitable material such as, for example, polyethylene or "Teslin" (e.g., about 7.5 mils thick and larger in area than the header part). The overlapping parts may be adhesively secured together in any suitable manner, or fused, or may be mechanically fastened together, as by stapling.

Figure 2:
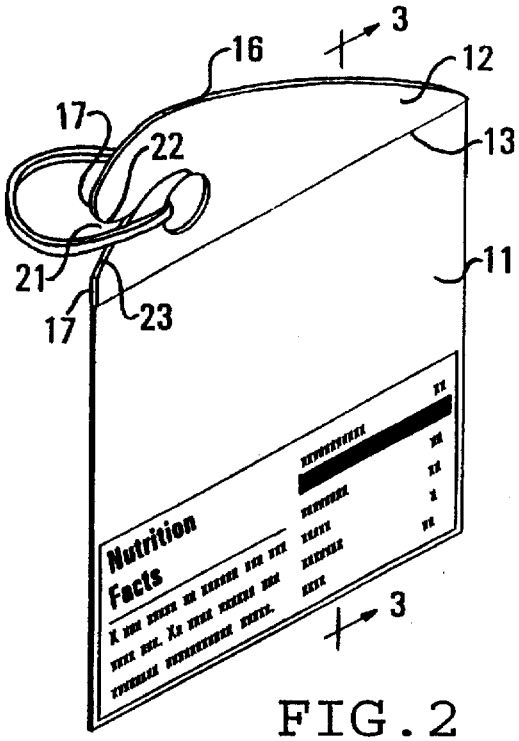
FIG. 2 is a schematic perspective view of the new locking tag and shows additional marking information and a significant change of thickness between the header part and the information part.

The information part 11 can have a multitude of informational markings on it. For banded agricultural produce, it should include a scannable product code or identification. This normally will be in the nature of a UPC marking and will include matter for the price of the product as well as product identification per se. Bar codes are the most popular and are fully effective to provide scannable product identification matter. Other information markings are illustrated in FIGS. 1 and 2 and include product look-up (PLU) numbers, a trademark identification, serving suggestions, storage suggestions, and nutrition facts. A variety of other markings perceived to enhance sales may be employed, not least of which may be an identification of the country of origin for the produce.

Figure 4:
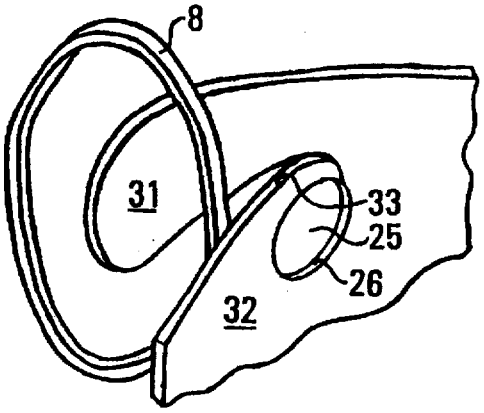
FIG. 4 is a fragmentary perspective view of the header portion and illustrates displacement of the hooking finger in the step of slipping the tag (i.e., the header part of the tag) into a locking condition on a band of material.
Figure 5:
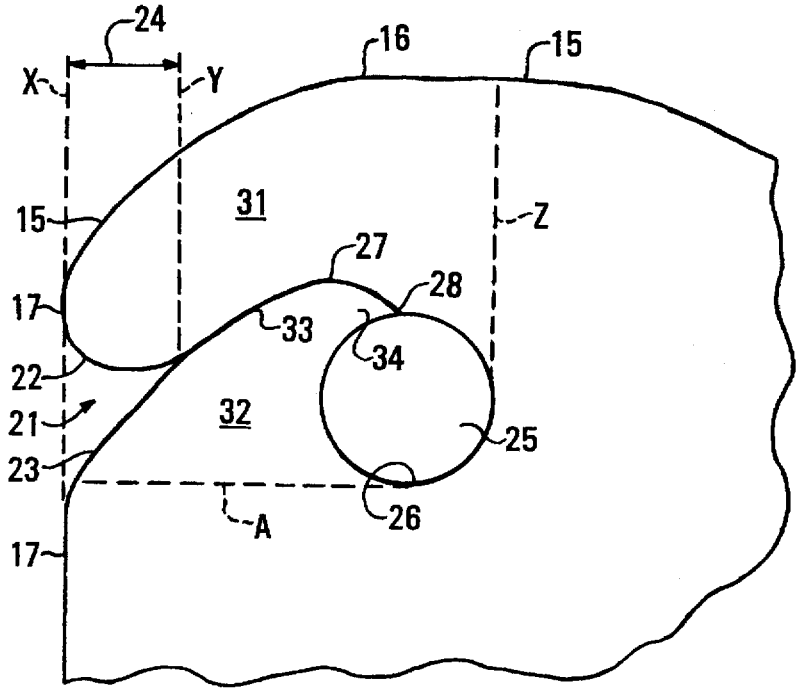
FIG. 5 is a schematic fragmentary view of the header portion of the new locking tag with zone markings to illustrate detailed features for the header part.

The header part 12 has a unique locking structure formed in it. Details of this structure and the relationships of different zones or portions of the header part and how the zones or portions function will now be discussed, with particular reference to FIG. 5 (and general reference to FIGS. 1, 2, and 4). As an initial matter, the header part always has an outer perimeter edge 15 about all portions of it except at the portion of the header part joined to the information part, which portion or zone is identified herein as the border 13 between the parts. The outer perimeter edge may vary in configuration, but ideally the outer perimeter edge has two significant portions that are interrelated. These portions are particularly illustrated in FIG. 5. One portion (e.g., along the top of the header part of the tag shown in FIG. 5) is the outer edge called the dominant outer perimeter edge 16. The other portion (e.g., along dashed line X depending along the left edge of the header part as illustrated in FIG. 5) is the outer perimeter edge that is called the subordinate outer perimeter edge 17. (The subordinate edge 17 has a mouth 21 in it, but nevertheless is looked upon as being in generally depending relationship from the dominant upper edge 16.) The relationship between the dominant and subordinate sections or stretches of the composite outer perimeter edge is emphasized to be approximately perpendicular in that the subordinate outer perimeter edge depends in a substantially perpendicular manner or relationship from the dominant outer perimeter edge. It is the relative relationship between the dominant and the subordinate outer edges, not the exact angular relationship, that is important. In other words, the subordinate edge lies in a generally perpendicular, not necessarily absolutely perpendicular, relationship to the dominant outer perimeter edge.

An open mouth 21 is in the subordinate outer perimeter edge. The open mouth has an upper lip edge 22 and a lower lip edge 23 in opposing relationship. It also has a depth dimension 24 extending inwardly from the subordinate outer perimeter edge. The depth dimension 24 (which also might be called the throat length) extends from the dashed line marked X in FIG. 5 to the inward line marked Y in FIG. 5, which line Y demarks the inwardmost end where the open mouth terminates.

A holding orifice 25 in the nature of a hole or aperture is inwardly spaced from both the open mouth 21 and the outer perimeter edge 15. Indeed, the orifice is inwardly spaced from all parts of the outer perimeter edge 15, both dominant 16 and subordinate 17. An internal edge 26 extends entirely about the hole or opening called the holding orifice, and there is a slit 28 that forms the entry or entrance into the orifice. The preferred location of this slit entrance or entry port is along a portion or section of the internal edge 26 of the orifice 25 that lies nearest the dominant outer perimeter edge 16 of the locking tag. When the dominant outer perimeter edge 16 is held uppermost, the slit entrance 28 into the orifice is at approximately a 12 o'clock location on the internal edge 26 of the holding orifice. Variation of an hour up to two hours from the 12 o'clock location can provide effective results in accordance with the teaching of this invention, but approximately the 12 o'clock location, or up to approximately one hour on either side of the 12 o'clock location, functions best to gain both ease of fastening the new locking tag on a band of material with a simple swift sweeping hand movement and effective substantially irreversible locking of the band material within the orifice. The most preferred location for the slit entrance in terms of irreversible locking of band material within the orifice should be no less than about 12 o'clock and extend into the 1 and 2 o'clock range. As the location for the slit entry 28 is moved more remotely from the mouth 21 (e.g., from the 12 o'clock location toward the 2 o'clock location or possibly even somewhat approaching a 3 o'clock location), the angle for the slit entry 28 into the orifice 25 should more and more approach a tangential relationship to the internal edge 26 of the orifice.

A slit entry channel 27 extends from the open mouth 21 (i.e., from the innermost portion of the open mouth at Y in FIG. 5) along a line passing between the conjunction of the dominant and subordinate outer perimeter edges (i.e., the intersection between the dominant edge 16 and subordinate edge 17), and the orifice 25. This slit entry channel 27 may be straight or may be somewhat curved. In ideal headers, it gradually curves at its termination at the slit entrance 28 into the orifice. To be emphasized is the fact that the slit entry channel passes transversely through the header part along the line between the outer perimeter edge 15 of the header part and the orifice 25 itself. Specifically, the line passes between the orifice 25 and the portion of the outer perimeter edge 15 where the dominant 16 and subordinate 17 outer perimeter edges merge or intersect. This places the slit line at a location quite literally extending between the open mouth and the orifice per se. The line is preferably curved, although the curvature may be slight in parts of it. Ideally, the terminal portion of the slit is curved toward the orifice 25 to form the entrance 28.

The structures formed on opposite sides of the slit entry channel resemble oppositely extending fingers. The fingers are on opposite sides of the slit entry channel. One of the fingers, specifically the upper finger (or finger along the dominant outer perimeter edge 16), is in the nature of an elongated hooking finger 31, which extends from the orifice 25 outwardly to terminate at the upper lip edge 22 of the open mouth. This hooking finger extends, therefore, from an approximate location identified by a line of dashes marked Z in FIG. 5 to the outer edge of the upper lip edge 22. The line marked Z is straight and is approximately tangential to the part of orifice 25 most remote from the mouth 21 and is approximately perpendicular to the dominant outer perimeter edge 16.

The other of the two fingers created by the entry channel is in the nature of a camming finger 32 having a camming surface 33 (common to the slit 27 of the entry channel) extending from the lower lip edge 23 of the open mouth to the orifice 25. The camming finger 32 also forms a terminal hook lock 34 at the entrance of the slit entry channel into the orifice, particularly as the entry channel is ideally curved at its terminus toward the orifice. Put another way, the curved slit entry channel 27 itself causes the camming surface 33 of the camming finger 32 to create an ideal terminal hook lock 34 at the entrance 28 into the orifice 25. The outer limits of width for the camming finger are defined by the slit entry channel 27 on one side and an imaginary dashed line marked A in FIG. 5 which runs tangentially from an approximately 6 o'clock location on orifice 25 to the subordinate outer perimeter edge 17 at a location approximately perpendicular to edge 17 and proximate to the lower lip 23 of the mouth 21.

The length of the hooking finger 31 between its base at Z and its outer end at upper lip 22 is significant. It has a length greater than its mean width, and its mean width is defined as the distance between the outer perimeter edge 16 and the slit of the entry channel 27 at approximately the midpoint between the ends of the hooking finger. This relationship as particularly illustrated in FIG. 5 also satisfies the criteria for the length of the hooking finger to be greater than its mean width where the mean width is taken at approximately the midpoint between the ends of the slit 27 of the entry channel. (The ends of the slit for the entry channel are at the start of it at Y in FIG. 5 to the end of it at its slit entrance 28 into the orifice 25.)

Another ideal relationship to note is that between the camming surface 33 and the hooking finger 31. This relationship is such that the hooking finger 31 is preferably substantially contiguous to the camming surface 33 over a distance at least as great as the depth dimension 24 of the open mouth. This contiguous relationship helps to maintain the orifice locking function of the new locking tag.

Importantly, the hook lock 34 of the camming finger is integrated with the holding orifice (and the contiguous relationship of the hooking finger) in a manner such that a section of band material 8 within the orifice 25 is substantially irreversibly locked in the orifice by the hook lock against exit therefrom. The little hook lock in the body of the camming finger cooperates with the internal edge of the orifice to obstruct the exit of band material from the orifice—i.e., obstruct passage of the band material out through the entry slit 28 along the camming surface 33 to the mouth 21 of the header part.

Combined with the feature that the hook lock 34 functions to lock band material 8 within the orifice against exit therefrom is the extremely significant feature of the ease by which the new locking tag is fastened to a section of band material in one sweeping hand movement, without the need to rotate or wiggle the locking tag about the band material. The elongated hooking finger contributes to this result as well as to the result of irreversibly locking band material within the orifice. The fact that the hooking finger is substantially contiguous to the camming surface 33 and therefore to the camming finger 32 over a quite significant length, preferably at least as great as the depth dimension of the open mouth 21, assists the hook lock 34 and its associated structures in holding band material against exit from the holding orifice.

Figure 3:
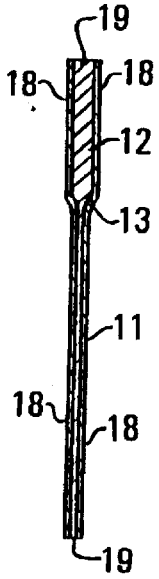
FIG. 3 is a cross-sectional view of the new locking tag taken along line 3—3 of FIG. 2, particularly illustrating a difference of thickness between the header and information parts.

The significant length of the elongated hooking finger 31 also contributes to special advantageous features. The hooking finger is easily latched transversely over a section of band material 8 in making a swinging hand movement. The band material finds its way into the mouth portion 21 of the header of the new locking tag. The result is that a continuation of the sweeping motion effectively causes or permits the section of band material entering the mouth to be guided by the hooking finger 31 along the camming surface 33 of the camming finger 32 into the holding orifice. This all can be accomplished by using one simple sweeping hand movement. The hooking finger 31 is indeed relatively displaced from a planar alignment during the step of locking the tag on a band 8 such as a rubber band or a twist tie. This relative displacement of the hooking finger 31 out of the plane of the camming finger 32 is illustrated in FIG. 4. The resiliency of the sheet material that forms the header part of the locking tag (e.g., plastic sheet materials such as polystyrene or polyethylene or other polyolefin as a major constituent) causes the locking finger 31 and camming finger 32 to resume their planar relationship once the band material 8 has become lodged within the holding orifice 25. Suitable resiliency is gained by simply employing slightly thicker sheet material for the header portion 12 or part as compared to the information part 11 of the total locking tag of the invention, and this feature is illustrated in FIG. 3. It is, however, well recognized in the art that the degree of resiliency in a plastic sheet material increases as the thickness is increased. Nevertheless, unnecessarily thick sheet materials only add to cost without adding desired functional performance. Thus, the thickness employed should be just sufficient to attain the resilience for the locking finger 31 to substantially return to the plane of the camming finger 32 after using a sweeping hand motion to put the band in the orifice 25.

The special elongated hooking finger 31 and the open mouth and lip edges, and the slit entry channel 27 from the open mouth 21 to the holding orifice 25, are important features contributing to the combination of ease of fastening the locking tag to a band material in combination with the high obstruction to removal of the band from the holding orifice, all within the parameter of sheet material that is not so outrageously thick as to be too expensive for practical acceptance by the users. Effective locking tags according to the practice of the invention may be formed using sheet material (with any of various plastics as the key or major component) for the header portion no greater in thickness than about 1.5 millimeters (about 60 mils), preferably no greater than about 1 mm (e.g., up to 1.2 mm). Indeed, reliable locking tags of the invention can be formed using headers 12 between about 0.4 and about 0.8 mm in thickness. The header part may even be down in thickness to as little as 0.3 mm where the relatively stiffer polyolefins such as polystyrene are used. The cooperation of the relatively long hooking finger 31 as a guide member contiguous to a special camming surface 33, plus any relatively more sharp ideal curvature of the camming surface at its terminal end entry point 28 into the holding orifice 25, permits the sheet material of the header part of this new locking tag to be relatively thinner, as compared to the thickness associated with other styles of locking closures which are symmetrical in configuration. The information part 11 may be equal in thickness to the header part but most preferably is made thinner than the header 12 by at least 0.1 mm (up to as much as 1.0 or 0.8 mm thinner than the headers of maximum realistic thickness). Generally, for ease of handling consistent with economy, the information part will approximate 0.2 mm in thickness, but it may vary from as little as about 0.1 mm (or 2 or 3 mils) up to about 0.4 or 0.6 mm in making the most economical locking tags of the invention. The new asymmetrical locking tags can withstand rather rough tumbling operations without suffering damage as the clumps of produce to which the locking tags are affixed are subjected to washing and cleaning operations.

An important feature with respect to the open mouth 21 and the relationship of it to the curved slit entry channel 27 is the fact that the innermost end of the depth dimension for the open mouth has the appearance of being more or less tucked under the upper lip edge 22 of the open mouth. This in part is an impression created by virtue of the fact that the preferred slit entry channel 27 tends to first move in a general direction of gradual curvature toward the dominant outer perimeter edge 16 as that entry channel passes along a line to the holding orifice. It is the terminal portion of the slit entry channel that preferably has a curvature that curves into the holding orifice at the location on the orifice of approximately 12 o'clock (i.e., the portion of the internal edge of the holding orifice nearest the dominant outer perimeter edge of the locking tag).

Importantly, the relatively elongated hooking finger 31 provides a sleek tool for latching on a band that has been placed around a clump of agricultural produce. The hooking finger 31 is relatively narrow and thus does not pass greatly into the banded clump when it is latched upon the band of rubber or twist tie material holding the clump together. Its features and performance are not likely to crush or damage the produce, whereas symmetrical style attachment tags tend to crush produce during the step of pushing such tags into produce as the symmetrical attachment means is pressed over a band about the produce.

Finger gripping of the new locking tag for the swinging motion to latch it upon a band about a clump of produce is preferably accomplished upon the header portion at a location on the header relatively remote from the mouth 21. Optionally, the finger gripping may be upon the information part 11 of the new locking tag. By far the most preferred finger gripping, however, is upon the header portion at a location on the side of the orifice remote from the mouth.

Figure 6:
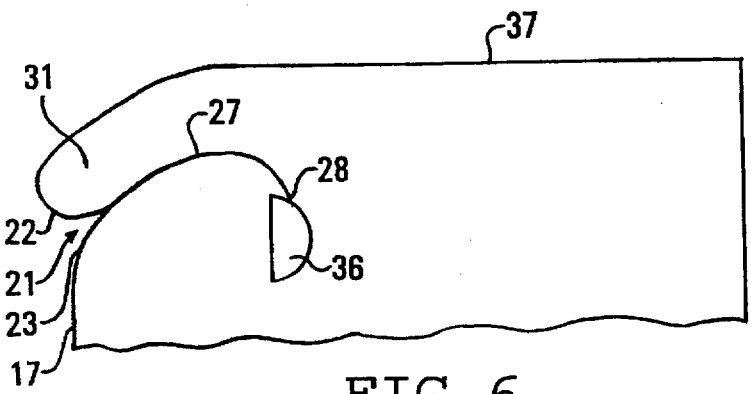
FIG. 6 is a schematic fragmentary view of a few alternative features for the header portion.

There are variations of structure that may be employed without significantly departing from the essential features of the invention. A few such variations are illustrated in FIG. 6. For example, the orifice 36 may be noncircular and nevertheless exhibit clock positions as desired, although of imperfect nature. An outer perimeter edge having its dominant portion 37 extending in more or less a straight line may be used, especially for the portion to the right of the orifice 36 (i.e., the portion extending away from the mouth and orifice of the header). (In all instances, the dominant outer perimeter edge is looked upon as extending in one main direction and the subordinate edge in a direction generally perpendicular to it.) The upper lip edge 22 (which merges and also forms the outwardmost end of hooking finger 31) preferably has a greater outward protrusion than the lower lip edge 23 as well as greater than the subordinate outer perimeter edge 17 at its merger with the lower lip edge 23. The greater outward protrusion of the upper lip edge should be at least just sufficient to abut a band material slid over the lower lip edge toward the upper lip edge. This relationship therefore contributes to entrance of the band material into the open mouth 21. Put another way, as the lower lip edge and its merged subordinate outer perimeter are pulled (and rubbed) over an outer side of band material about banded merchandise, the point is reached where the slightly protruding upper lip edge becomes more or less perpendicularly abutted against the band and simultaneously causes the band to enter the mouth 21.

Figure 8:
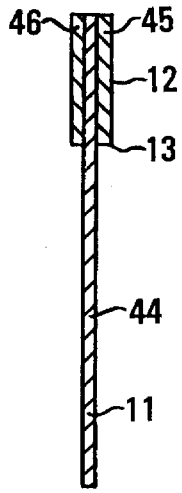
FIG. 8 is a schematic cross-sectional view of a new locking tab of the invention having a thin base sheet forming the information part and having the base sheet extend into the header part which is formed by laminating film to one or both sides of the base sheet at the header portion.

An especially useful technique for providing a relatively stiff and resilient header, while simultaneously employing a flexible base sheet material substantially uniformly thick throughout and common to both the information part and the header part of the locking tag, is that of laminating film to one or both sides of the base sheet to form the header. This approach is illustrated in FIG. 8. The base sheet 44 may consist of flexible sheet material of any desired uniform thickness, but most preferably will be exceedingly thin and flexible printable sheet material. A "Teslin" sheet as thin as about 0.1 mm (2 or 3 mils) may be used as the base sheet 44; optionally the base sheet 44 may comprise an exceedingly thin (e.g., about 0.2 mm thick) laminate having printable tissue on one or both sides of a core of polyethylene or some other thermoplastic. Even thicker but still very thin base sheets 44 may be employed. However, the benefits of the embodiment illustrated in FIG. 8 are largely lost if the base sheet thickness is so great as to stiffen the base sheet to the point where it exhibits sufficient resilience to perform as a header. Thus, in forming the structure of FIG. 8, exceedingly thin and flexible but printable base sheets 44 are to be used. Any suitable printing may be placed on the base sheet at its information portion 11 (or for that matter, all over the base sheet 44) before laminating one or more header films 45 and 46 to the portion of the base sheet 44 which functions as the header part 12. Illustrative films 45 and 46 for lamination to form the header part ideally fall in the polyester family, e.g., polyethylene terephthalate, including any of a variety of modified or recycled esters of terephthalate. A 48-gauge (about 0.5 mils thick) Mylar polyester film may be used. While the use of ester films is preferred, they are not critical. Non-ester polymeric films may alternatively be used, but greater film thicknesses may sometimes be needed for ease of handling, as well as for achieving the stiffening for the header part. The benefit of polyester films arises from their relative ease of handling in printing machinery and the ease by which printing machinery can be employed to adhesively laminate them to a base film using known adhesive technology. A variety of known bonding adhesives and known surface treatments to enhance adhesion may be used. A useful approach is to employ adhesive formulations that can be cured (e.g., cross-linked or polymerized) in situ by using ultraviolet light. The benefit of such an approach is that it can save one from removing volatile solvents from an adhesive coating; but solvent-based adhesives may be employed, if desired. Hot melt adhesives present another approach that avoids the need for solvent removal, and polyurethane hot melt adhesives, especially those that are moisture curable, are illustrative of those useful for uniting polyester films. Ethylene vinyl acetate adhesives can also be useful for header laminations. Water-borne adhesives present another approach. Any of variety of other adhesives known to adhesive technicians may be used. After lamination, the header is ready to have its features die cut.

Those skilled in the art will readily recognize that still other specific forms than illustrated may be employed without departing from the spirit or essential characteristics of the invention. All variations that come within the scope and meaning of the claims, and the range of equivalency for the claims, are therefore intended to be embraced thereby.

That which is claimed is:

1. A locking tag for fastening to merchandise, said locking tag comprising sheet material having an information part and a resilient header part united together along a border between said parts, said information part being for printed matter, said header part comprising an outer perimeter edge about said header part except at said border, an open mouth in said outer perimeter edge, said open mouth having an upper lip edge in opposing relationship to a lower lip edge and having a depth dimension extending inwardly from said outer perimeter edge, a holding orifice inwardly spaced from said open mouth as well as from said outer perimeter edge, a slit entry channel from said open mouth transversely through said header part along a line terminating as a slit entrance into said orifice, oppositely extending fingers on opposite sides of said slit entry channel, one said finger being an elongated hooking finger extending from said orifice outwardly to terminate at the upper edge of said open mouth, the other said finger being a camming finger having a camming surface extending from the lower edge of said open mouth to said orifice, a terminal hook lock formed by said camming finger at the entrance of said slit entry channel into said orifice, said elongated hooking finger of said locking tag being easily latched transversely over a section of band material to cause movement of the band material along said camming surface into said holding orifice with one sweeping hand movement.

2. The locking tag of claim 1 wherein said information part includes printed matter comprising a scannable merchandise marking and wherein said sheet material and printed matter are water-resistant.

3. The locking tag of claim 1 wherein said sheet material consists essentially of a laminate of printable paper material on opposite sides of an internal plastic core to which the paper material on opposite sides is fused.

4. The locking tag of claim 1 wherein said sheet material comprises a thermoplastic polymer and said information part and header part are integrally united without the presence of any adhesive or mechanical fastener.

5. The locking tag of claim 1 wherein the sheet material of said header part is thicker than the sheet material of said information part.

6. The locking tag of claim 1 wherein said sheet material of said information part extends as the base sheet material of said header part, and wherein said header part comprises one or more films laminated onto said base sheet to thereby thicken and stiffen said header part as compared to said information part.

7. The locking tag of claim 1 wherein the material of said header part differs from the material of said information part, and the material of one said part overlaps upon the material of the other said part.

8. The locking tag of claim 1 wherein said header part has an area size smaller than said information part.

9. The locking tag of claim 1 wherein said outer perimeter edge of said locking tag includes a dominant outer perimeter edge extending mainly in one direction and a subordinate outer perimeter edge in depending approximately perpendicular relationship to said dominant outer perimeter edge, and wherein said open mouth is along said subordinate outer perimeter edge.

10. The locking tag of claim 9 wherein said orifice has an internal edge and the part of said internal edge nearest said dominant outer perimeter edge is considered a 12 o'clock location, and wherein said slit entrance into said orifice is at said location of approximately 12 o'clock plus or minus two hours on said internal edge of said orifice.

11. The locking tag of claim 9 wherein the line of said slit entry channel includes a portion that passes between the conjunction of said dominant and subordinate outer perimeter edges and said orifice.

12. The locking tag of claim 1 wherein said hooking finger has a length greater than its mean width, said mean width being defined as the distance between said outer perimeter edge of said header part and said entry channel at approximately the midpoint between the ends of said hooking finger.

13. The locking tag of claim 1 wherein said upper lip edge has a greater outward protrusion than said lower lip edge and wherein the greater outward protrusion of said upper lip edge is just sufficient to abut a band material slid over said lower lip edge toward said upper lip edge and thereby contribute to entrance of the band material into said open mouth.

14. A locking tag for fastening to merchandise, said locking tag comprising sheet material having an information part and a resilient header part united together along a border between said parts, said information part including printed matter thereon, said header part comprising an outer perimeter edge about said header part except at said border, an open mouth in said outer perimeter edge, said open mouth having an upper lip edge in opposing relationship to a lower lip edge and having a depth dimension extending inwardly from said outer perimeter edge, a holding orifice inwardly spaced from said open mouth as well as from said outer perimeter edge, a slit entry channel from said open mouth transversely through said header part along a line terminating as a slit entrance into said orifice, oppositely extending fingers on opposite sides of said slit entry channel, one said finger being an elongated hooking finger extending from said orifice outwardly to terminate at the upper edge of said open mouth, the other said finger being a camming finger having a camming surface extending from the lower edge of said open mouth to said orifice, a terminal hook lock formed by said camming finger at the entrance of said slit entry channel into said orifice, said hooking finger having a length greater than its mean width, said mean width being defined as the distance between said outer perimeter edge of said header part and said entry channel at approximately the midpoint between the ends of said hooking finger, the relationship between said camming surface and said hooking finger being such that said hooking finger is substantially contiguous to said camming surface over an approximate length at least as great as the depth dimension of said open mouth, said elongated hooking finger of said locking tag being easily latched transversely over a section of band material to cause movement of the band material along said camming surface into said holding orifice with one sweeping hand movement.

15. The locking tag of claim 14 wherein said printed matter on said information part comprises a scannable merchandise marking and wherein said sheet material and printed matter are water-resistant.

16. The locking tag of claim 14 wherein said sheet material consists essentially of a laminate of printable paper material on opposite sides of an internal plastic core to which the paper material on opposite sides is fused.

17. The locking tag of claim 14 wherein said sheet material comprises a thermoplastic polymer and said information part and header part are integrally united without the presence of any adhesive or mechanical fastener.

18. The locking tag of claim 14 wherein the sheet material of said header part is thicker than the sheet material of said information part.

19. The locking tag of claim 14 wherein said sheet material of said information part extends as the base sheet material of said header part, and wherein said header part comprises one or more films laminated onto said base sheet to thereby thicken and stiffen said header part as compared to said information part.

20. The locking tag of claim 14 wherein the material of said header part differs from the material of said information part, and the material of one said part overlaps upon the material of the other said part.

21. The locking tag of claim 14 wherein said header part has an area size smaller than said information part.

22. The locking tag of claim 14 wherein said outer perimeter edge of said locking tag includes a dominant outer perimeter edge extending mainly in one direction and a subordinate outer perimeter edge in depending approximately perpendicular relationship to said dominant outer perimeter edge, and wherein said open mouth is along said subordinate outer perimeter edge.

23. The locking tag of claim 22 wherein said orifice has an internal edge and the part of said internal edge nearest said dominant outer perimeter edge is considered a 12 o'clock location, and wherein said slit entrance into said orifice is at said location of approximately 12 o'clock plus or minus two hours on said internal edge of said orifice.

24. The locking tag of claim 22 wherein the line of said slit entry channel includes a portion that passes between the conjunction of said dominant and subordinate outer perimeter edges and said orifice.

25. The locking tag of claim 14 wherein said upper lip edge has a greater outward protrusion than said lower lip edge and wherein the greater outward protrusion of said upper lip edge is just sufficient to abut a band material slid over said lower lip edge toward said upper lip edge and thereby contribute to entrance of the band material into said open mouth.

26. A locking tag for fastening to merchandise, said locking tag comprising a sheet material having an information part and header part united together along a border between said parts, said information part including printed matter thereon, said header part having an area size smaller than said information part, an outer perimeter edge about all portions of said header part except at said border, said outer perimeter edge having a dominant portion extending in one main direction and a subordinate portion in depending approximately perpendicular relationship to said dominant outer perimeter edge, an open mouth in said subordinate outer perimeter edge, said open mouth having an upper lip edge in opposing relationship to a lower lip edge and having a depth dimension extending inwardly from said subordinate outer perimeter edge, said upper lip edge having a greater outward protrusion than said lower lip edge along said subordinate perimeter edge, a holding orifice inwardly spaced from said outer perimeter edge as well as from said open mouth, said orifice having an internal edge whose portion nearest said dominant outer perimeter edge is called a 12 o'clock location, an entry channel from said open mouth to said orifice, said entry channel having edges formed by a slit extending transversely through said header part from said open mouth along a line that includes a portion that passes between the conjunction of said dominant and subordinate outer perimeter edges and said orifice and then extends in a curvature to terminate as a slit into said orifice at a location along said internal edge of said orifice of approximately 12 o'clock plus or minus two hours, an elongated hooking finger of greater length than width extending from said orifice outwardly to the upper lip edge of said open mouth, said hooking finger having an outer edge common to said dominant outer perimeter edge and having an internal edge coextensive with one edge of said curved slit, and a camming finger having a camming surface extending substantially contiguous to the internal edge of said hooking finger, said camming finger having a terminal hook lock at the curvature of said camming surface into said orifice, said hooking finger of said locking tag being easily latched transversely over a section of band material to cause movement of the section of band material from said mouth of said header part through said entry channel slit into said holding orifice with one sweeping hand movement, said hook lock of said camming finger being integrated with said holding orifice for substantially irreversibly locking a band material in said orifice.

27. A locking tag for fastening to merchandise, said locking tag comprising sheet material having an information part and a resilient header part united together along a border between said parts, said information part being for printed matter, said sheet material forming said information part being such as to extend as the base sheet material of said header part, said header part having one or more films laminated onto said base sheet to thereby thicken and stiffen said header part as compared to said information part, said header having an outer perimeter edge about all portions of said header part except at said border, said outer perimeter edge having a dominant portion opposite said border and a subordinate portion extending between said dominant portion and said border, an open mouth in said subordinate portion, said open mouth having an upper lip edge in opposing relationship to a lower lip edge and having a depth dimension extending inwardly from said subordinate portion, a holding orifice inwardly spaced from said outer perimeter edge as well as from said open mouth, and a slit entry channel extending from said mouth and terminating as a slit entrance into said orifice, said upper lip edge having a contour extending in a curve merging with said dominant portion of said outer perimeter edge and thus defining a curved end for a hooking finger on said subordinate portion, said hooking finger being for latching transversely over a section of band material to thereby facilitate movement of the band material through said slit entry channel into said orifice.

28. The locking tag of claim 27, additionally comprising a terminal hook lock at the entrance of said slit entry channel into said orifice.

29. A locking tag for fastening to merchandise, said marking tag comprising sheet material having an information part and a resilient header part united together along a border between said parts, said information part being for printed matter, said header part comprising an outer perimeter edge about said header part except at said border, an open mouth in said outer perimeter edge, said open mouth having an upper lip edge in opposing relationship to a lower lip edge and having a depth dimension extending inwardly from said outer perimeter edge, a holding orifice inwardly spaced from said open mouth as well as from said outer perimeter edge, a slit entry channel extending from said open mouth transversely through said header part along a line terminating as a slit entrance into said orifice, an elongated hooking finger having one side defined by said entry channel and an opposite side defined by said outer perimeter edge, said hooking finger extending from said orifice outwardly to terminate at the upper lip edge of said open mouth, a camming surface along the side of said entry channel opposite said hooking finger, said camming surface extending from the lower lip edge of said open mouth to said orifice, said elongated hooking finger being easily latched transversely over a section of band material about merchandise to cause movement of the band material along said camming surface into said holding orifice with one sweeping hand movement.

30. The tag of claim 29 wherein said information part includes printed matter comprising a scannable merchandise marking and wherein said sheet material and printed matter are water-resistant.

31. The tag of claim 29 wherein the sheet material of said header part is thicker than the sheet material of said information part.

32. The tag of claim 29 wherein the material of said header part differs from the material of said information part, and the material of one said part overlaps upon the material of the other said part.

33. The tag of claim 29 wherein said hooking finger has a length greater than its mean width, said mean width being defined as the distance between said outer perimeter edge of said header part and said entry channel at approximately the midpoint between the ends of said hooking finger.

34. The tag of claim 29 wherein said upper lip edge has a greater outward protrusion from said orifice than said lower lip edge and wherein the greater outward protrusion of said upper lip edge is just sufficient to abut a band material slid over said lower lip edge toward said upper lip edge and thereby contribute to entrance of the band material into said open mouth.

35. The tag of claim 29 wherein the relationship between said camming surface and said hooking finger is such that said hooking finger is substantially contiguous to said camming surface over an approximate length at least as great as the depth dimension of said open mouth.

36. The tag of claim 29 wherein a terminal hook lock is formed by said camming finger at the entrance of said slit entry channel into said orifice, said hook lock of said camming finger being so integrated with said holding orifice that a section of band material in said holding orifice is substantially irreversibly locked in said orifice by said hook lock against exit therefrom.

37. The tag of claim 29 wherein said outer perimeter edge of said locking tag includes a dominant outer perimeter edge extending mainly in one direction and a subordinate outer perimeter edge in depending approximately perpendicular relationship to said dominant outer perimeter edge, and wherein said open mouth is along said subordinate outer perimeter edge.

38. The tag of claim 37 wherein said orifice has an internal edge and the part of said internal edge nearest said dominant outer perimeter edge is considered a 12 o'clock location, and wherein said slit entrance into said orifice is at said location of approximately 12 o'clock plus or minus two hours on said internal edge of said orifice.

39. The tag of claim 37 wherein the line of said slit entry channel includes a portion that passes between the conjunction of said dominant and subordinate outer perimeter edges and said orifice.

40. A locking tag for fastening to merchandise, said locking tag comprising sheet material having an information portion and a header portion, said information portion being for printed matter, said header portion having a dominant outer perimeter edge located most distant from said information portion and a subordinate outer perimeter edge extending between said dominant outer perimeter edge and said information portion, an open mouth in said subordinate outer perimeter edge, said open mouth having an upper lip edge in opposing relationship to a lower lip edge and having a depth dimension extending inwardly from said subordinate outer perimeter edge, a holding orifice inwardly spaced from said dominant outer perimeter edge and said subordinate outer perimeter edge as well as from said open mouth, and a slit entry channel extending from said mouth and terminating as a slit entrance into said orifice, said upper lip edge having a contour extending in a curve merging with said dominant outer perimeter edge and thus defining a curved end for a hooking finger on said subordinate outer perimeter edge, said hooking finger being for latching transversely over a section of band material to thereby facilitate movement of the band material through said slit entry channel into said orifice.

41. The locking tag of claim 40 additionally comprising a terminal hook lock at the entrance of said slit entry channel into said orifice.

* * * * *